US010626642B2

(12) United States Patent
Mooney

(10) Patent No.: US 10,626,642 B2
(45) Date of Patent: Apr. 21, 2020

(54) RAILCAR DOME LID DEVICE

(71) Applicant: Railserve, Inc., Atlanta, GA (US)

(72) Inventor: Phil Mooney, Gibbons (CA)

(73) Assignee: Railserve, Inc., Atlanta, GA (US)

( * ) Notice: Subject to any disclaimer, the term of this patent is extended or adjusted under 35 U.S.C. 154(b) by 285 days.

(21) Appl. No.: 15/907,686

(22) Filed: Feb. 28, 2018

(65) Prior Publication Data

US 2019/0264479 A1 Aug. 29, 2019

(51) Int. Cl.
*E05C 17/54* (2006.01)
*B65D 90/00* (2006.01)

(52) U.S. Cl.
CPC ..... *E05C 17/54* (2013.01); *B61D 5/08* (2013.01)

(58) Field of Classification Search
CPC ..... B61D 5/08; E05C 17/047; E05C 17/54; A47J 36/12; G09F 7/18; G09F 1/14; Y10T 24/206; E01F 9/669; E01F 9/673
USPC ..... 248/205.1, 230.3, 228.1, 211; 105/377.05, 377.07
See application file for complete search history.

(56) References Cited

U.S. PATENT DOCUMENTS

D31,091 S * 6/1899 Handly ..... D25/132
1,945,375 A * 1/1934 Pazandak ..... B65D 43/24 217/61
2,156,872 A * 5/1939 Roberts ..... A61G 17/00 24/329
3,840,135 A 10/1974 Bridge
4,570,816 A 2/1986 Ferris et al.
4,584,984 A * 4/1986 Croft ..... A47J 37/0786 126/25 R
5,213,299 A * 5/1993 Henry ..... A47J 37/0786 126/25 R
8,584,597 B2 11/2013 DeLacerda et al.
9,260,118 B2 2/2016 Douglas et al.
9,718,616 B1 8/2017 Deming et al.
2006/0127178 A1* 6/2006 Akkala ..... E02D 29/14 404/25

(Continued)

FOREIGN PATENT DOCUMENTS

CA 1090977 A 12/1980
CN 202447261 U 9/2012

(Continued)

OTHER PUBLICATIONS

Website: Wikidot.com, "Solar Box Cooker," visited Nov. 28, 2017, <http://greencooking.wikidot.com/solar-box-cooker-photos>.

*Primary Examiner* — Mark T Le
(74) *Attorney, Agent, or Firm* — Banner & Witcoff, Ltd.

(57) ABSTRACT

A device is provided to assist rail car loaders when loading rail cars and to hold open the rail car dome lid to further prevent from closing while the rail car loader is working in the dome lid area. Additionally, this invention allows for improved egress when the rail car loader is working on the rail cars. The device for a railcar dome lid enables and holds the railcar dome lid open and to sit at a near a 90-degree angle without the possibility of the railcar dome lid falling closed on an operator. The railcar dome lid device includes a base member and an internal holding arm on the inside of the railcar dome wall. The base member includes two arms, with one arm on the outside of the railcar dome wall and one arm that props up against and holds the railcar dome lid open.

20 Claims, 14 Drawing Sheets

(56) References Cited

U.S. PATENT DOCUMENTS

2013/0192488 A1 8/2013 Low et al.

FOREIGN PATENT DOCUMENTS

| | | | |
|---|---|---|---|
| CN | 103170441 | B | 6/2016 |
| EP | 3067295 | B1 | 9/2017 |

* cited by examiner

RAILCAR DOME LID DEVICE

FIELD OF INVENTION

The field of invention for this disclosure relates to a device for a railcar dome lid that enables and holds the railcar dome lid open.

BACKGROUND

Railcars may include very heavy dome lids on the dome or wells or manways of the railcars. The possibility exists for these dome lids to fall closed on an operator when the operator is working on the railcar with the railcar dome lid open. There is a safety hazard due to the potential of a rail car dome lid falling/closing on an employee when working within the area. Additionally, the dome lids rested on the halo or railing of the fall protection system. The invention may further prevent further equipment damage to the halo or railing of the fall protection system as a result of the dome lids resting on fall protection system when dome lids were in the open position. The dome lids can weigh between 40-80 pounds.

A need exists for a portable apparatus that enables the railcar dome lid to sit at a near 90 degree angle. With the railcar dome lid at a 90 degree angle, the walkways on the railcars can be lined up with the top platform of the railcar more effectively, thus making the entraining and detraining safer.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

The present disclosure provides a mechanical tool designed to assist rail car loaders when loading rail cars. The disclosure provides a device for holding a railcar dome lid in an open configuration, the railcar dome lid configured to cover a dome on a railcar. The device includes a base member that includes a lid arm and an external holding arm opposite the lid arm; an internal holding arm; a joining arm, and a support member. The lid arm may prop up against and hold the railcar dome lid open. The external holding arm may be engaged with an external wall of the dome on the railcar. The base member may be 1-½"×1-½" square tubing. The internal holding arm may be parallel to the external holding arm and engaged with an internal wall of the dome on the railcar. The internal holding arm may be 1-½"×1-½" square tubing. The joining arm may extend perpendicularly from the base member and connect the internal holding arm and the external holding arm. The joining arm may seat on a rim of the dome on the railcar. The joining arm may be 1-½"×1-½" square tubing. The support member may be attached to the lid arm and the joining arm, wherein the support member is a rod.

According to another aspect of the disclosure, the disclosure provides a device for holding a railcar dome lid in an open configuration, the railcar dome lid configured to cover a dome on a railcar. The device may comprise: a base member that includes a lid arm and an external holding arm opposite the lid arm, and internal holding arm parallel to the external holding arm, and a joining arm that extends perpendicularly from the base member and connects the internal holding arm and the external holding arm. The lid arm may prop up against and hold the railcar dome lid open. The external holding arm may be engaged with an external wall of the dome on the railcar. The base member may be 2"×2" square tubing. The internal holding arm may be engaged with an internal wall of the dome on the railcar. The internal holding arm may be 2"×2" square tubing. The joining arm may seat on a rim of the dome on the railcar. The distance between the internal holding arm and the external holding arm may be approximately 1 inch.

According to yet another aspect of the disclosure, the disclosure provides a device for holding a railcar dome lid in an open configuration, the railcar dome lid configured to cover a dome on a railcar. The device may comprise: a base member that includes a lid arm and an external holding arm opposite the lid arm, an internal holding arm parallel to the external holding arm, a joining arm that extends perpendicularly from the base member and connects the internal holding arm and the external holding arm, and a support member attached to the lid arm and the joining arm. The lid arm may prop up against and hold the railcar dome lid open. The external holding arm may engage with an external wall of the dome on the railcar. The base member may be ⅛" thick wall 1-½"×1-½" aluminum square tubing. The base member may be approximately 21-22 inches long and the lid arm may be approximately 10-11 inches long. The internal holding arm may be engaged with an internal wall of the dome on the railcar. The internal holding arm may be ⅛" thick wall 1-½"×1-½" aluminum square tubing. The internal holding arm and the external holding arm may be approximately 10-11 inches long. The joining arm may seat on a rim of the dome on the railcar. The joining arm may be ⅛" thick wall 1-½"×1-½" aluminum square tubing and may be approximately 3 inches long. The support member may be an aluminum rod in a 90-degree shape.

According to yet another aspect of the disclosure, the disclosure provides a device for holding a railcar dome lid in an open configuration, the railcar dome lid configured to cover a dome on a railcar. The device may comprise: a base member that includes a lid arm and an external holding arm opposite the lid arm, an internal holding arm parallel to the external holding arm, and a joining arm that extends perpendicularly from the base member and connects the internal holding arm and the external holding arm. The lid arm may prop up against and hold the railcar dome lid open. The external holding arm may be engaged with an external wall of the dome on the railcar. The base member may be ¼" thick wall 2"×2" steel square tubing. The base member may be approximately 33-35 inches long and the lid arm may be approximately 18-20 inches long. The internal holding arm may be engaged with an internal wall of the dome on the railcar. The internal holding arm may be ¼" thick wall 2"×2" steel square tubing. The internal holding arm and the external holding arm may be approximately 14-16 inches long. The joining arm may seat on a rim of the dome on the railcar. The joining arm may be ¼" thick wall 2"×2" steel square tubing. The joining arm may be approximately 1 inch long.

BRIEF DESCRIPTION OF THE DRAWINGS

The present invention is illustrated by way of example and not limited in the accompanying figures in which like reference numerals indicate similar elements and in which.

Figure 1:
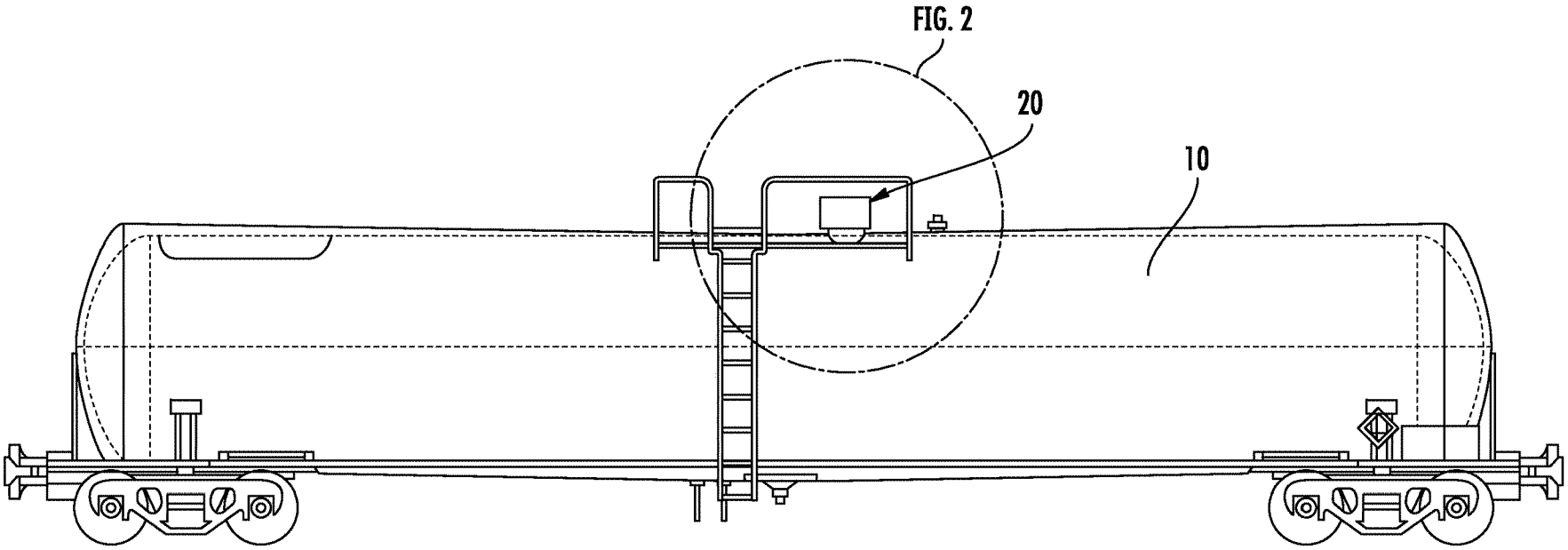
FIG. 1 illustrates a perspective view of an overall railcar to be used according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "upper," "lower," "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Connected," as used herein, indicates that components may be connected directly being physically contacting each other or connected indirectly where the components are connected indirectly where the components do not physically contact, but have one or more intermediate components positioned between them.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto. Pieces joined with such a technique are described as "integrally joined."

In the following description of the various embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made without departing from the scope and spirit of the present disclosure.

In general, as described above, aspects of this invention relate to a mechanical tool designed to assist rail car loaders when loading rail cars. The purpose of this invention is to assist rail car loaders to hold open the rail car dome lid and to further prevent from closing while the rail car loader is working in the dome lid area. Additionally, this invention allows for improved egress when the rail car loader is working on the rail cars. This invention was conceived to assist the rail car loaders in preventing the dome lid from closing abruptly and potentially causing injury or equipment damage and to prevent damage to the fall protection systems.

Aspects of this invention relate to an device for a railcar dome lid that enables and holds the railcar dome lid open and to sit at a near a 90-degree angle without the possibility of the railcar dome lid falling closed on an operator. Generally, the design may be in the shape of a lower case "h" with a carrying handle. The tool may be used on a variety of rail tank cars typically used in the loading of product into rail tank cars. The railcar dome lid device includes a base member and an internal holding arm on the inside of the railcar dome wall. The base member includes two arms, with one arm on the outside of the railcar dome wall and one arm that props up against and holds the railcar dome lid open. More detailed descriptions of aspects of this invention follow.

Figure 2A:
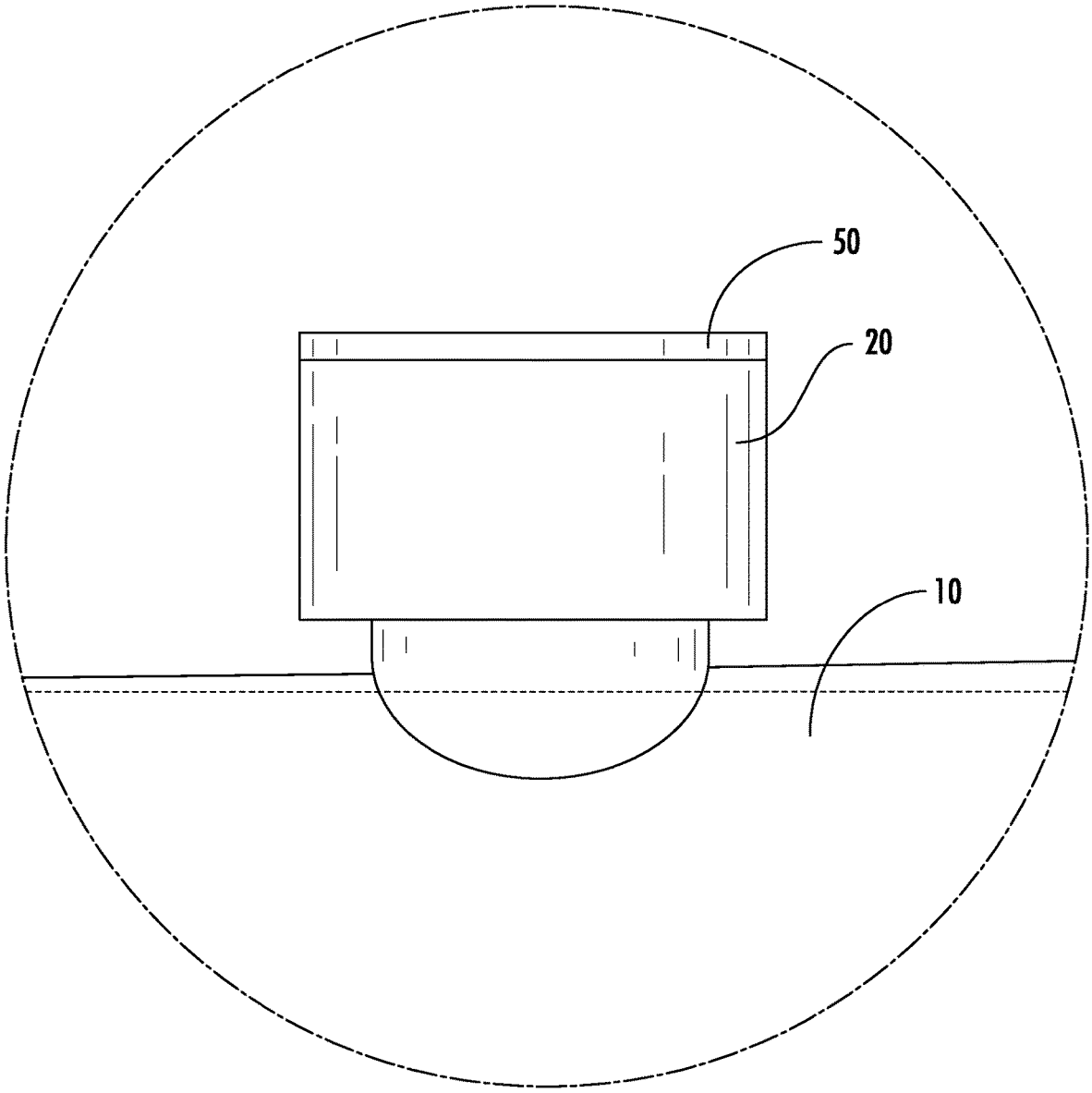
FIG. 2A illustrates a perspective view of a railcar dome lid on the railcar from FIG. 1 with the railcar dome lid in a closed configuration.
Figure 2B:
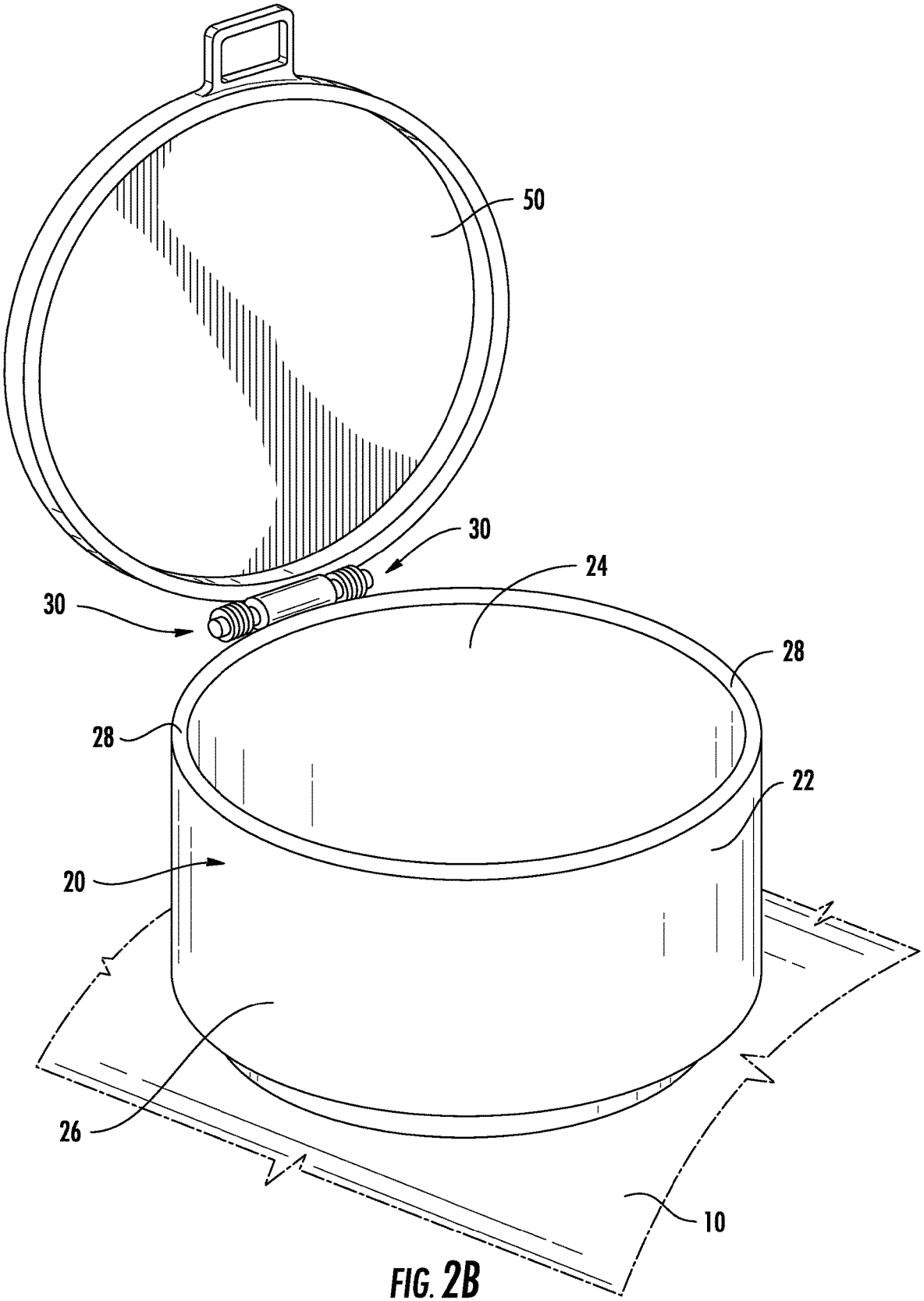
FIG. 2B illustrates a perspective view of the railcar dome lid from FIG. 2 with the railcar dome lid in an open configuration without the railcar dome lid device.

FIG. 1 illustrates an overall railcar 10 with a railcar dome 20. FIG. 2A illustrates the railcar dome 20 with a railcar dome lid 50 in a closed configuration on the railcar 10. FIG. 2B further illustrates the railcar dome 20 and the railcar dome lid 50 in an open configuration on the railcar 10. As illustrated in FIG. 1, the railcar 10 includes a railcar dome 20 and a railcar dome lid 50. The railcar dome 20 and the railcar dome lid 50 illustrated in FIGS. 1, 2A, and 2B, may be circular in shape and may be located on a top portion of the railcar 10. As specifically illustrated in FIG. 2B, the railcar dome 20 may include an circular/cylindrical wall 22 with an internal portion 24 and an external portion 26. The wall 22 may also include a rim portion 28 that seats the railcar dome lid 50 when the railcar dome lid 50 is in a closed configuration. Additionally, a hinge gap space 30 may be located between the railcar dome 20 and the railcar dome lid 50 when the railcar dome lid 50 is in an open configuration.

Figure 3A:
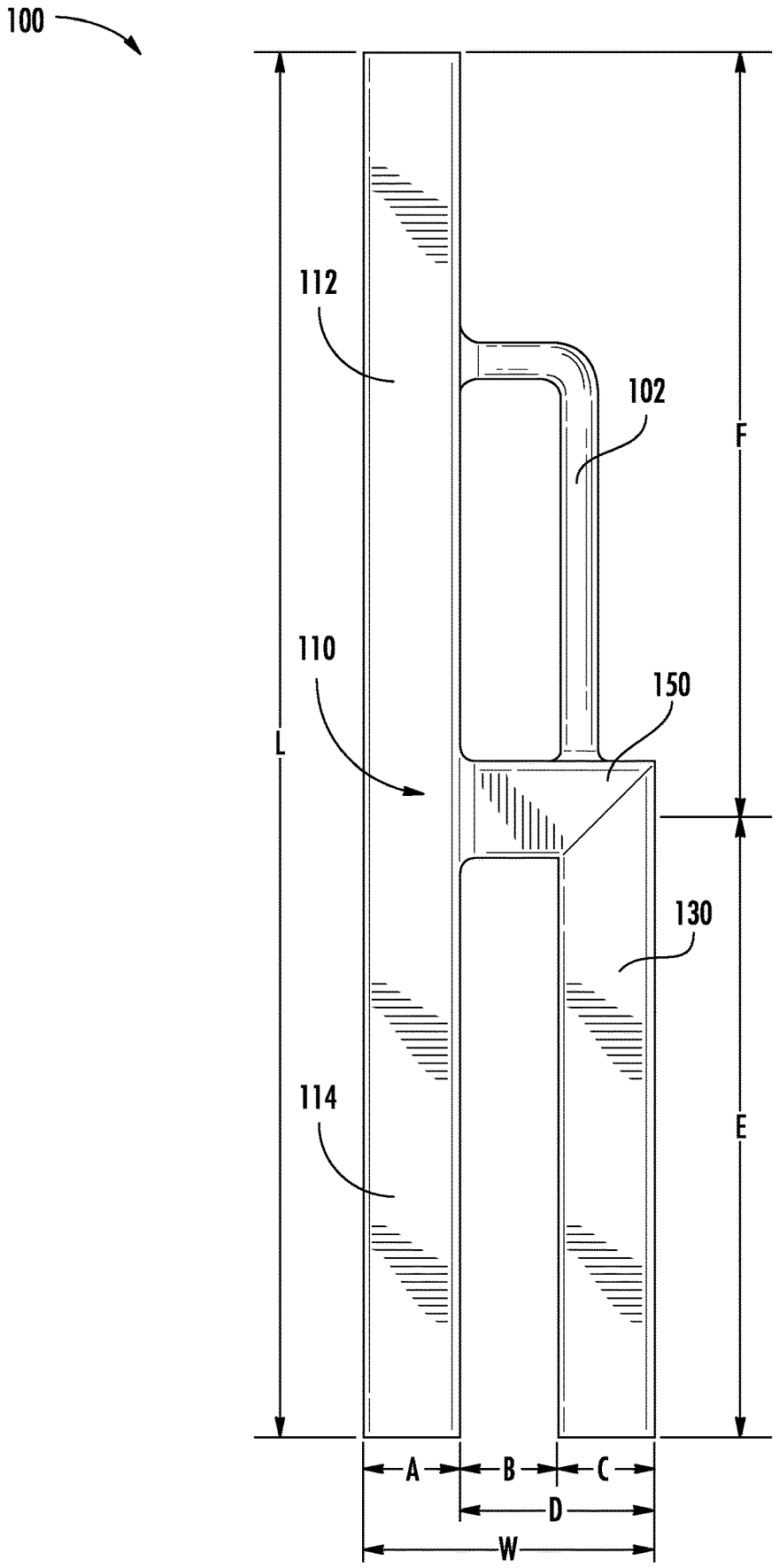
FIG. 3A illustrates a side view of an example embodiment of a railcar dome lid device for use with the railcar dome lid from FIG. 2 and according to one or more aspects described herein.
Figure 3B:
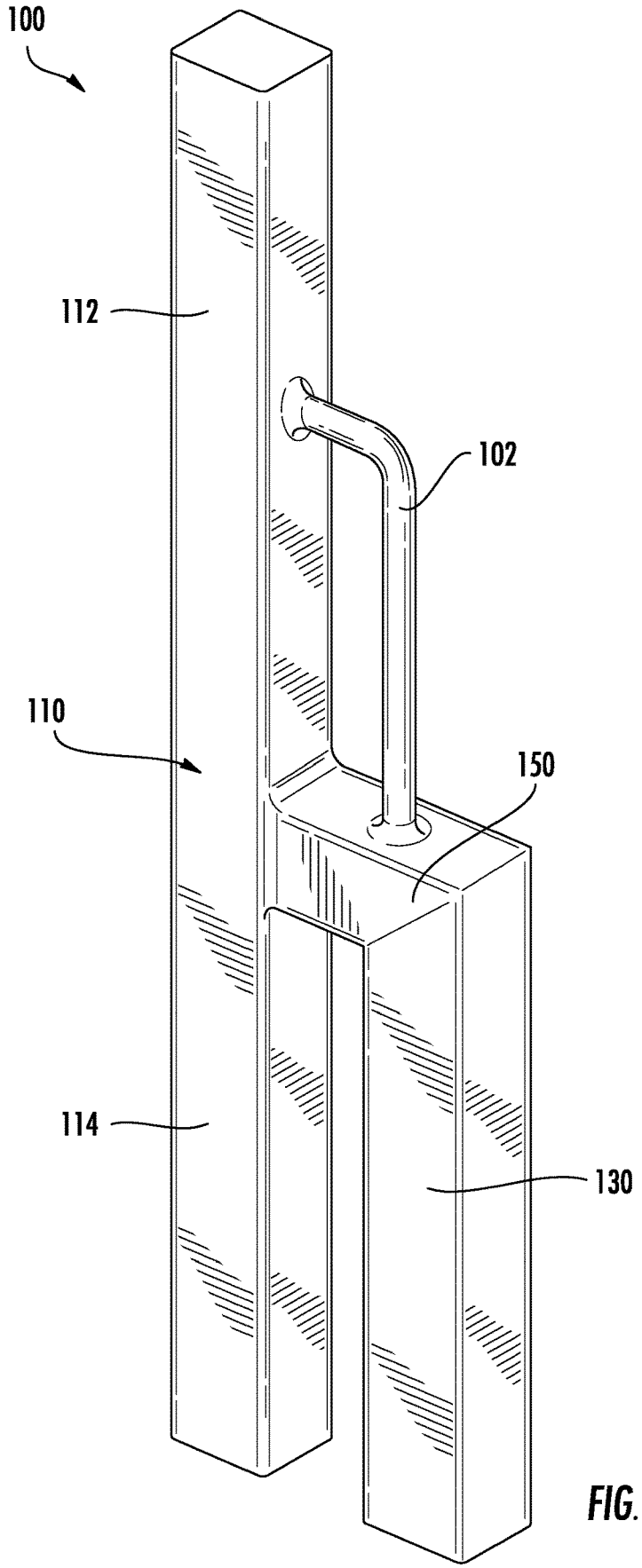
FIG. 3B illustrates a perspective angled view of the railcar dome lid device from FIG. 3A.
Figure 4A:
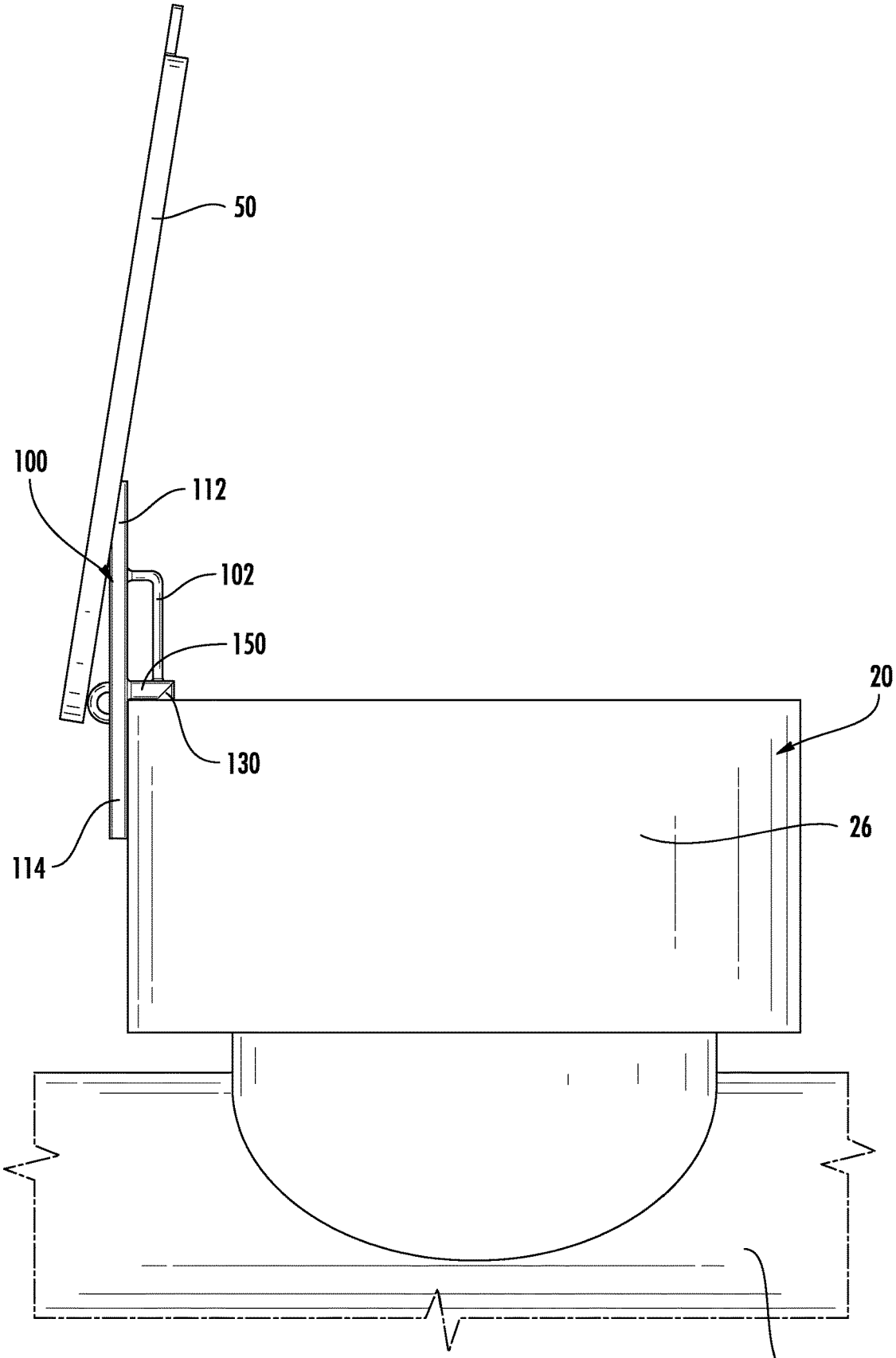
FIG. 4A illustrates a side perspective view of the railcar dome lid from FIG. 2 and the railcar dome lid device from FIG. 3A installed according to one or more aspects described herein.
Figure 4B:
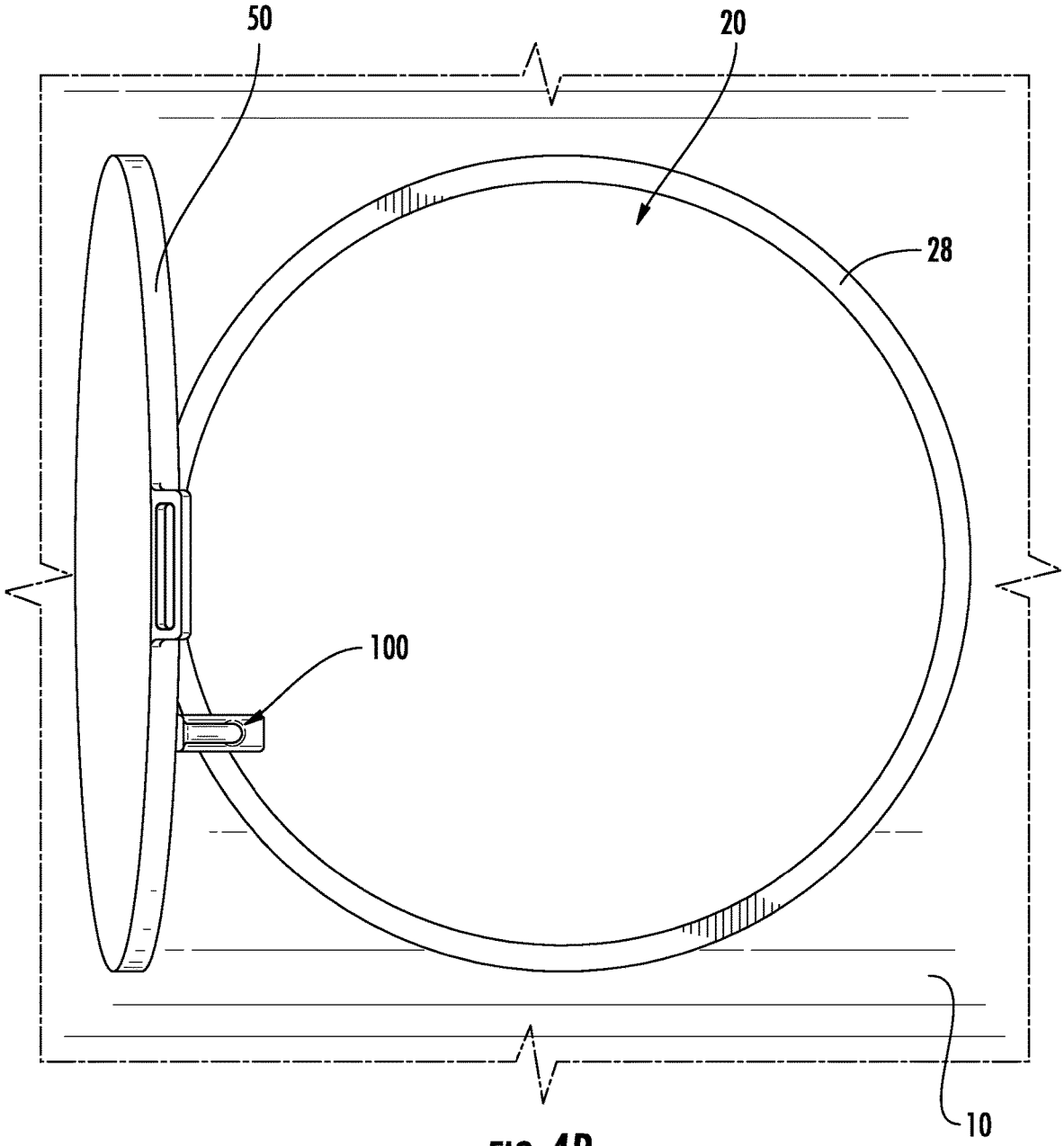
FIG. 4B illustrates a top perspective view of the railcar dome lid from FIG. 2 and the railcar dome lid device from FIG. 3A installed according to one or more aspects described herein.
Figure 4C:
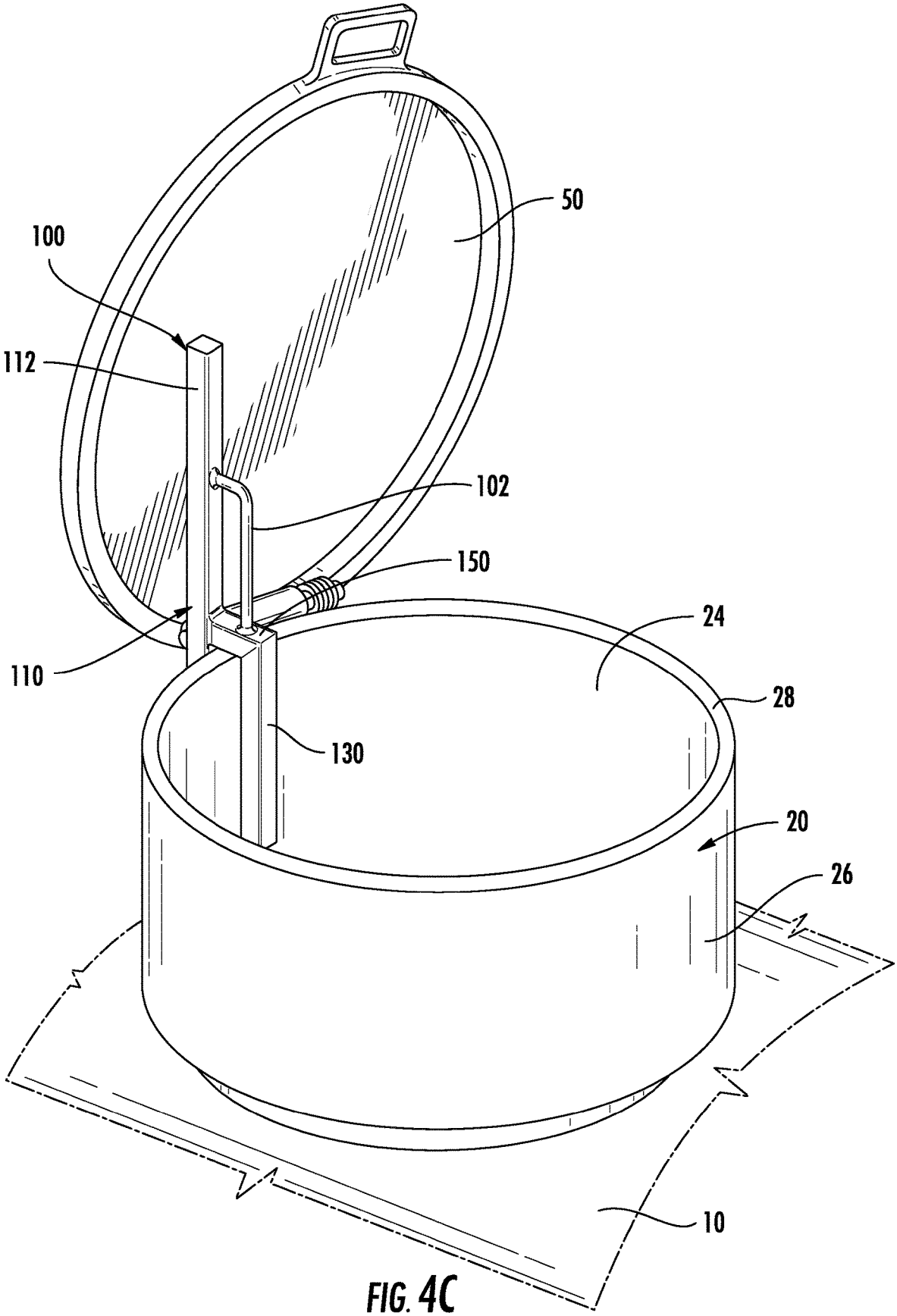
FIG. 4C illustrates an angled perspective view of the railcar dome lid from FIG. 2 and the railcar dome lid device from FIG. 3A installed according to one or more aspects described herein.

One aspect of this invention relates to a railcar dome lid device 100, as shown in FIGS. 3A-4C. FIGS. 3A and 3B illustrate a first embodiment of a railcar dome lid device 100 for use with the railcar dome lid 50. FIGS. 4A-4C illustrate different views of the railcar dome lid device 100 installed on the railcar dome lid 50 of the railcar 10. Generally, the shape of the railcar dome lid device 100 may be in the shape of a lower case "h". The railcar dome lid device 100 may include a base member 110 and an internal holding arm 130. The internal holding arm 130 may be connected to the base member 110 with a joining arm 150. The base member 110 includes a lid arm 112 that props up against and holds the railcar dome lid 50 open. The base member 110 also includes an external holding arm 114 opposite the lid arm 112. The external holding arm 114 may be engaged with the external portion 26 of the railcar dome wall 22. The internal holding arm 130 may be engaged with the internal portion 24 of the railcar dome wall 22. Additionally, as illustrated in FIGS. 3A and 3B, the railcar dome lid device 100 may include a support member 102 that is attached to the lid arm 112 and the joining arm 150.

The base member 110 may be an aluminum tubing. Other materials of tubing may be utilized for the base member 110. The length (L) of the base member 110 may be approximately 21-½ inches or within a range of 20 inches to 24 inches or within a range of 14 inches to 28 inches. As described above, the base member 110 may include a lid arm 112 and an external holding arm 114. The length (E) of the external holding arm 114 may be approximately 10-½ inches or within a range of 10 inches to 12 inches or within a range of 8 inches to 14 inches. The length (F) of the lid arm 112 may be approximately 11 inches or within a range of 10 inches to 12 inches or within a range of 8 inches to 14 inches. Additionally, in an exemplary embodiment, the base member 110 may be 1-½"×1-½" square tubing. The base member 110 may include ⅛" thick tubing or other thicknesses without departing from this invention. The base member 110 may be other configurations without departing from this invention.

The joining arm 150 may extend perpendicularly from the base member 110. The joining arm 150 may extend from the base member 110 at the approximate midpoint of the base arm 110. Additionally, the joining arm 150 may extend from the base member 110 within a range from approximately 8 inches from the top to 8 inches from the bottom of the base arm 110. The joining arm 150 may be an aluminum tubing. Other materials of tubing may be utilized for the base joining arm 150. The joining arm 150 may be connected to or welded to the base member 110. Other joining methods, such as an integral joining technique may be utilized without departing from this invention. The joining arm 150 may be approximately 3 inches in length (D), thereby extending from the base member 110 approximately 3 inches, or within a range of 2 inches to 4 inches or within a range of 2 inches to 6 inches. The width (W) of the railcar dome lid device 100 will be approximately 4-½ inches or other widths without departing from this invention. Additionally, in an exemplary embodiment, the joining arm 150 may be 1-½"×1-½" square tubing. The joining arm 150 may include ⅛" thick tubing or other thicknesses without departing from this invention. The joining arm 150 may be other configuration without departing from this invention.

The internal holding arm 130 may extend perpendicularly from the joining arm 150 in a direction away from the lid arm 112. The internal holding arm 130 will be parallel to the base arm 110 and the external holding arm 114. The internal holding arm 130 may have approximately 1-½" space (B) or within a range of 1 inches to 3 inches between the base arm 110 and the external holding arm 114. The internal holding arm 130 may be an aluminum tubing. Other materials of tubing may be utilized for the internal holding arm 130. The internal holding arm 130 may be connected to or welded to the joining arm 130. Other joining methods, such as an integral joining technique may be utilized without departing from this invention. The internal holding arm 130 may be approximately 10 inches in length (E) or within a range of 10 inches to 12 inches or within a range of 8 inches to 14 inches. The internal holding arm 130 may thereby extend from the joining arm 150 to an end of the base arm 110 and the external holding arm 114. The length (E) of the internal holding arm 130 will most likely match the distance from the joining arm 150 to the end of the base arm 110 and the length (E) of the external holding arm 114. Additionally, in an exemplary embodiment, the internal holding arm 130 may be 1-½"×1-½" square tubing. The internal holding arm 130 may include ⅛" thick tubing or other thicknesses without departing from this invention. The internal holding arm 130 may be other configuration without departing from this invention.

The railcar dome lid device 100 may also include a support member 102 that is attached to the lid arm 112 and the joining arm 150. The support member 102 may also act as a carry handle for the railcar dome lid device 100. The support member 102 may extend perpendicularly from the lid arm 112. The support member 102 may include a 90-degree bend to attach perpendicularly to the joining arm 150. The support member 102 may be an aluminum rod. Other materials of tubing may be utilized for the support member 102. The support member 102 may be connected to or welded to the lid arm 112 and the joining arm 150. Other joining methods, such as an integral joining technique may be utilized without departing from this invention. The support member 102 may extend from the lid arm 112 approximately 1-9/16 inches or within a range of 1 inch to 4 inches. The support member 102 may extend from the joining arm 150 approximately 6 inches or within a range of 5 inches to 10 inches or within a range of 4 inches to 12 inches. The support member 102 may extend different dimensions without departing from this invention. Additionally, in an exemplary embodiment, the support member 102 may be ½" rod. The support member 102 may be other configuration without departing from this invention.

FIGS. 4A-4C illustrate the operation and configuration of the railcar dome lid device 100 with respect to the railcar dome lid 50. After opening the railcar dome lid 50 to a 90-degree opening, the railcar dome lid device 100 is inserted into a hinge gap 30 of the dome lid 50 with the railcar dome lid 50 resting on the railcar dome lid device 100. As illustrated in FIGS. 4A-4C, the lid arm 112 props up against and holds the railcar dome lid 50 open. The external holding arm 114 engages with the external portion 26 of the railcar dome wall 22. The internal holding arm 130 engaged with and holds on the internal portion 24 of the railcar dome wall 22. The joining arm 150 sets and holds the railcar dome lid device 100 on the top rim 28 of the railcar dome wall 22.

Figure 5A:
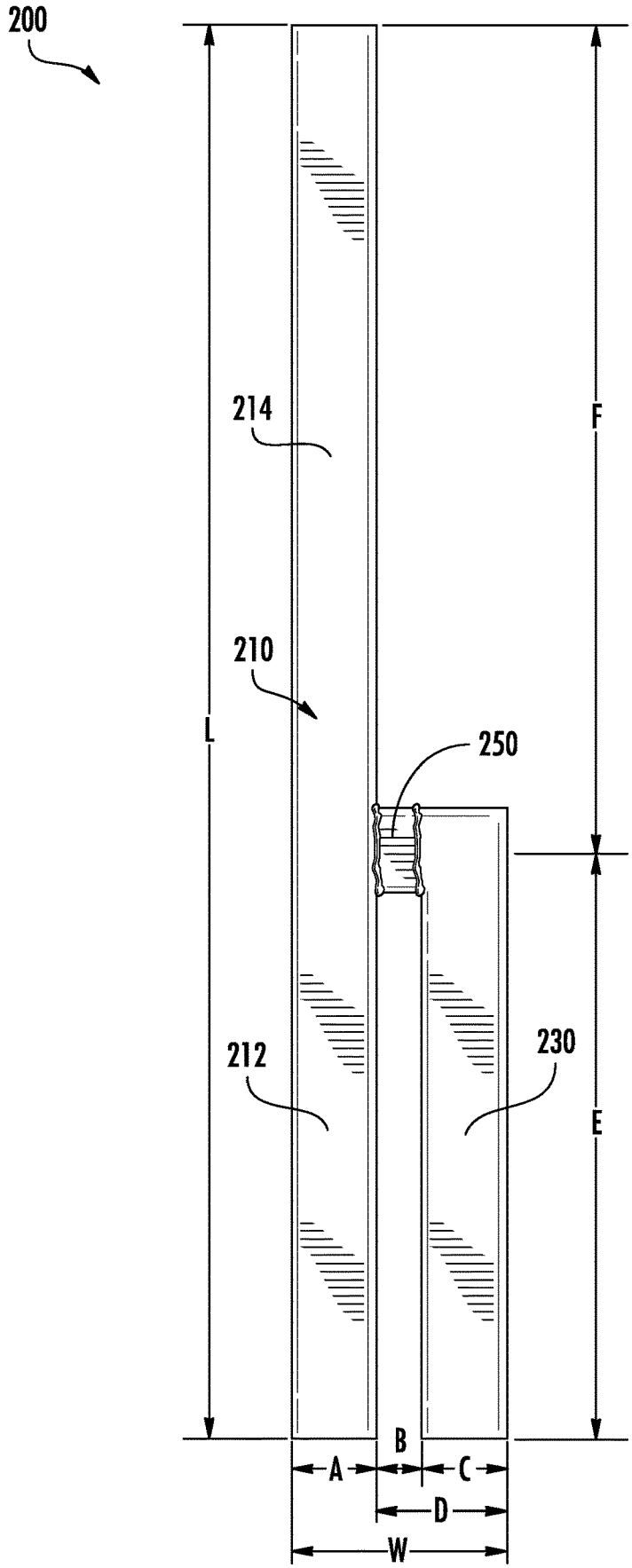
FIG. 5A illustrates a side view of an example embodiment of a second railcar dome lid device for use with the railcar dome lid from FIG. 2 and according to one or more aspects described herein.
Figure 5B:
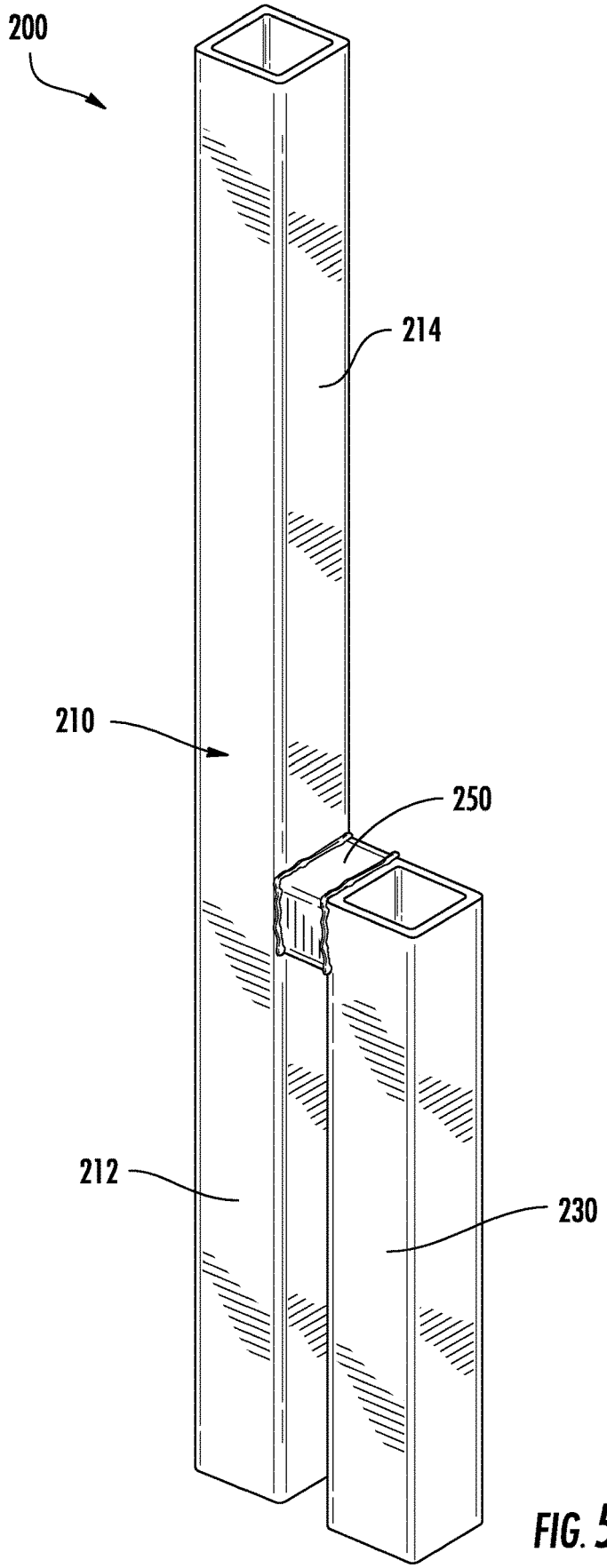
FIG. 5B illustrates a perspective angled view of the railcar dome lid device from FIG. 5A.
Figure 5C:
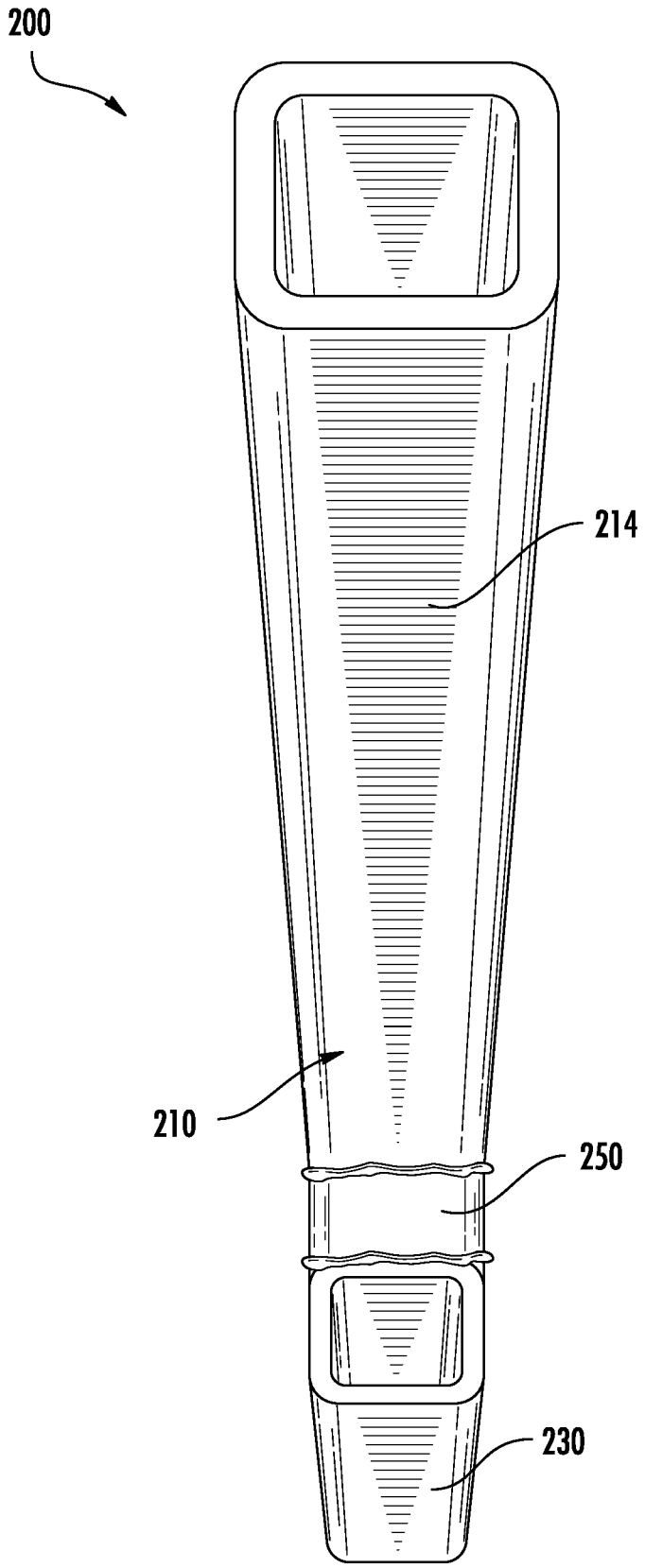
FIG. 5C illustrates a front perspective view of the railcar dome lid device from FIG. 5A.
Figure 6A:
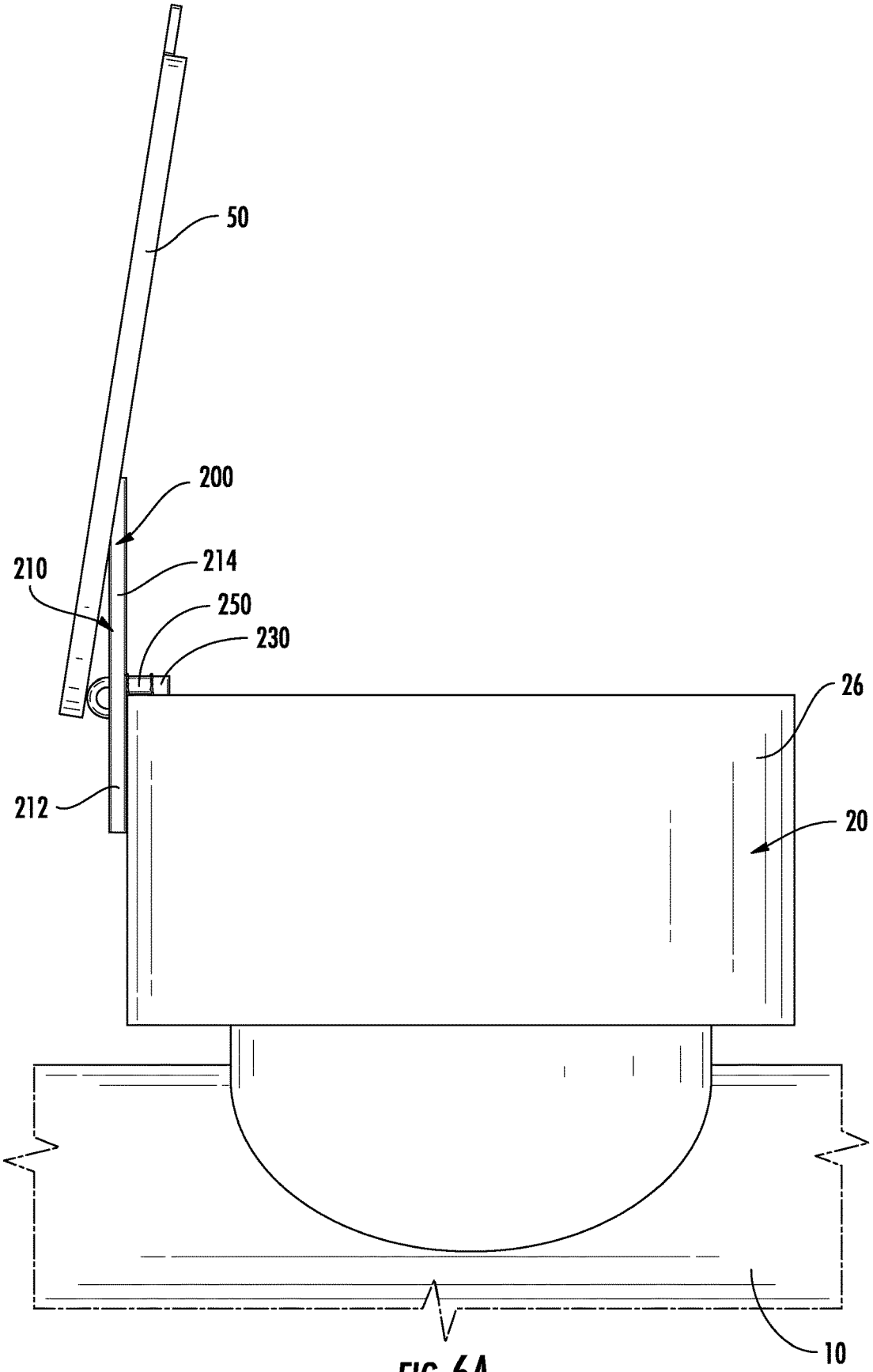
FIG. 6A illustrates a side perspective view of the railcar dome lid from FIG. 2 and the railcar dome lid device from FIG. 5A installed according to one or more aspects described herein.
Figure 6B:
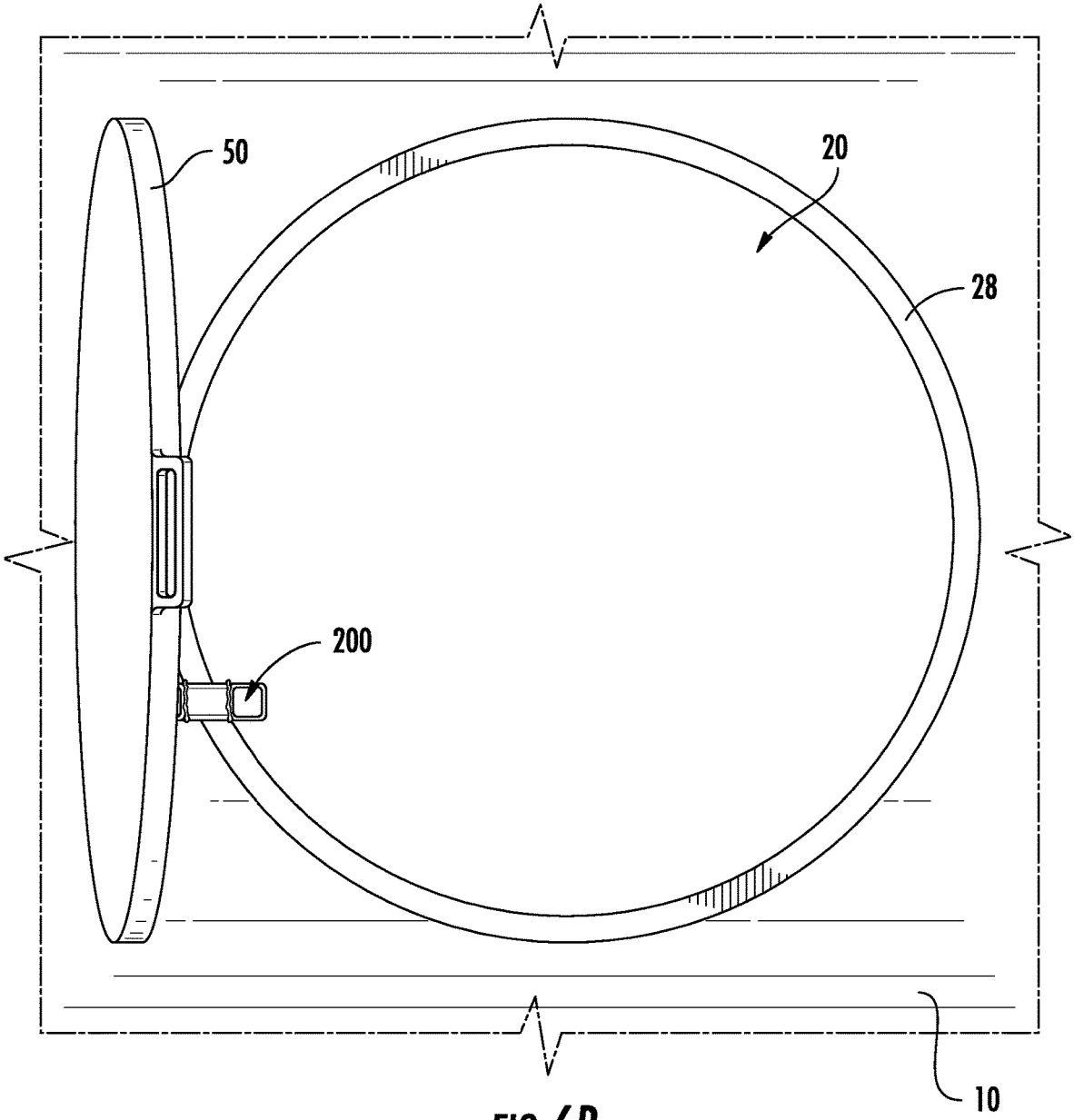
FIG. 6B illustrates a top perspective view of the railcar dome lid from FIG. 2 and the railcar dome lid device from FIG. 5A installed according to one or more aspects described herein.
Figure 6C:
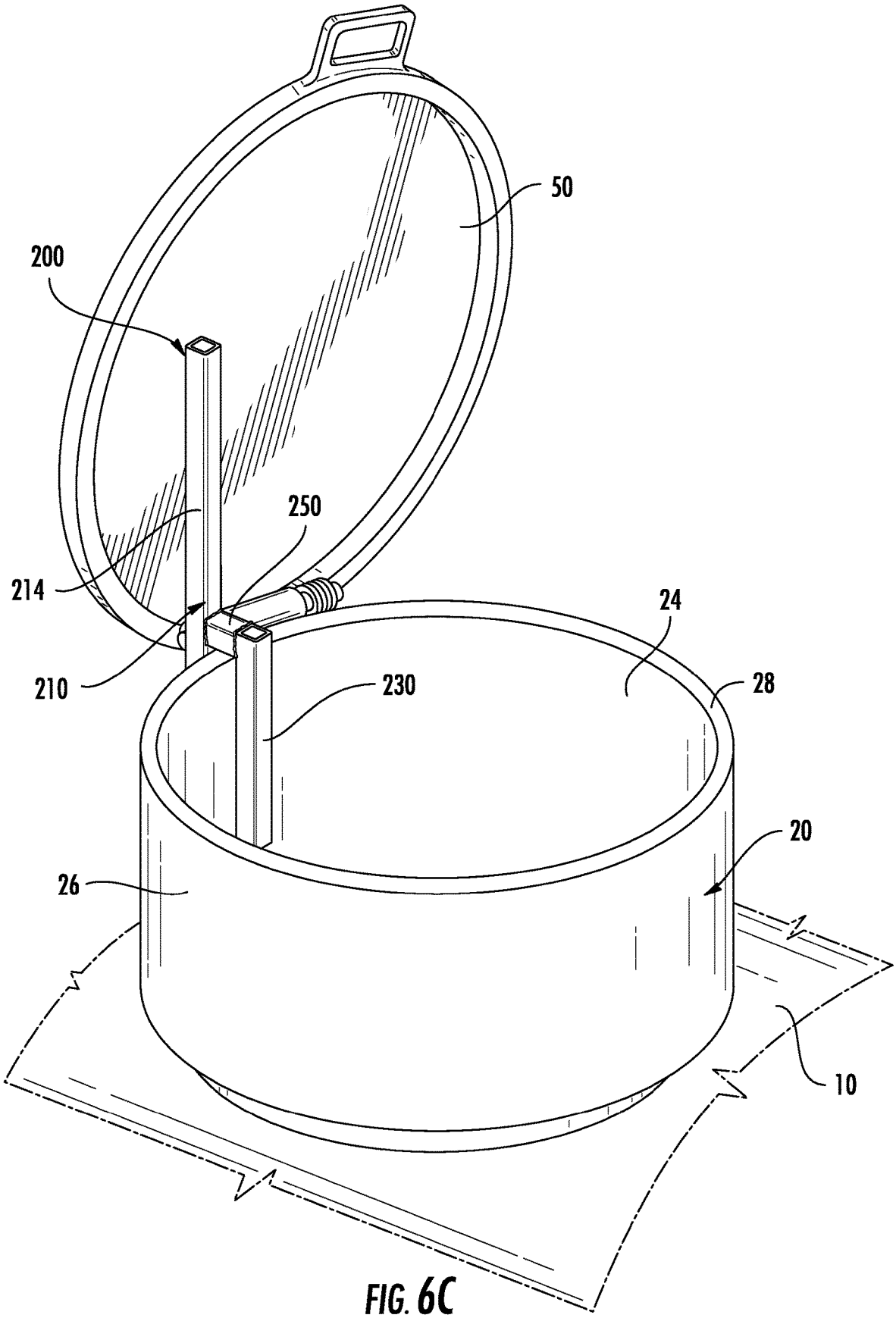
FIG. 6C illustrates an angled perspective view of the railcar dome lid from FIG. 2 and the railcar dome lid device from FIG. 5A installed according to one or more aspects described herein.

Another aspect of this invention relates to a second embodiment of a railcar dome lid device 200, as shown in FIGS. 5A-6C. Specifically, FIGS. 5A-5C illustrate the railcar dome lid device 200 for use with the railcar dome lid 50. FIGS. 6A-6C illustrate different views of the railcar dome lid device 200 installed on the railcar dome lid 50 of the railcar 10. Generally, the shape of the railcar dome lid device 200 may be in the shape of a lower case "h". The railcar dome lid device 200 may include a base member 210 and an internal holding arm 230. The internal holding arm 230 may be connected to the base member 210 with a joining arm 250. The base member 210 includes a lid arm 212 that props up against and holds the railcar dome lid 50 open. The base member 210 also includes an external holding arm 214 opposite the lid arm 221. The external holding arm 214 may be engaged with the external portion 26 of the railcar dome wall 22. The internal holding arm 230 may be engaged with the internal portion 24 of the railcar dome wall 22.

The base member 210 may be a steel tubing. Other materials of tubing may be utilized for the base member 210. The length (L) of the base member 210 may be approximately 34 inches or within a range of 30 inches to 38 inches or within a range of 26 inches to 42 inches. As described above, the base member 210 may include a lid arm 212 and an external holding arm 214. The length (E) of the external holding arm 214 may be approximately 15 inches or within a range of 13 inches to 17 inches or within a range of 10 inches to 20 inches. The length (F) of the lid arm 212 may be approximately 19 inches or within a range of 17 inches to 21 inches or within a range of 15 inches to 24 inches. Additionally, in an exemplary embodiment, the base member 210 may be 2"×2" square tubing. The base member 210 may include ¼" thick tubing or other thicknesses without departing from this invention. The base member 210 may be other configurations without departing from this invention.

The joining arm 250 may extend perpendicularly from the base member 210. The joining arm 250 may extend from the base member 210 at the approximately 15 inches from the bottom of the base arm 210 or within a range from approximately 12 inches to 18 inches from the bottom of the base arm 210 or within a range from approximately 10 inches to 20 inches from the bottom of the base arm 210. The joining arm 250 may be a steel tubing. Other materials of tubing may be utilized for the joining arm 250. The joining arm 250 may be connected to or welded to the base member 210. Other joining methods, such as an integral joining technique may be utilized without departing from this invention. The joining arm 250 may be approximately 1 inch in length (D), thereby extending from the base member 210 approximately 1 inch, or within a range of 1 inch to 3 inches or within a range of 1 inch to 6 inches. The width (W) of the railcar dome lid device 200 will be approximately 5 inches or other widths without departing from this invention. Additionally, in an exemplary embodiment, the joining arm 250 may be 2"×2" square tubing. The joining arm 250 may include ¼" thick tubing or other thicknesses without departing from this invention. The joining arm 250 may be other configuration without departing from this invention.

The internal holding arm 230 may extend perpendicularly from the joining arm 250 in a direction away from the lid arm 212. The internal holding arm 230 will be parallel to the base arm 210 and the external holding arm 214. The internal holding arm 230 may have approximately 1 inch space (B) or within a range of 1 inch to 6 inches between the base arm 210 and the external holding arm 214. The internal holding arm 230 may be a steel tubing. Other materials of tubing may be utilized for the internal holding arm 230. The internal holding arm 230 may be connected to or welded to the joining arm 250. Other joining methods, such as an integral joining technique may be utilized without departing from this invention. The internal holding arm 230 may be approximately 15 inches in length (E) or within a range of 12 inches to 18 inches or within a range of 10 inches to 20 inches. The internal holding arm 230 may thereby extend from the joining arm 250 to an end of the base arm 210 and the external holding arm 214. The length (E) of the internal holding arm 230 will most likely match the distance from the joining arm 250 to the end of the base arm 210 and the length (E) of the external holding arm 214. Additionally, in an exemplary embodiment, the internal holding arm 230 may be 2"×2" square tubing. The internal holding arm 230 may include ¼" thick tubing or other thicknesses without departing from this invention. The internal holding arm 230 may be other configuration without departing from this invention.

FIGS. 6A-6C illustrate the operation and configuration of the railcar dome lid device 200 with respect to the railcar dome lid 50. After opening the railcar dome lid 50 to a 90-degree opening, the railcar dome lid device 200 is inserted into a hinge gap 30 of the dome lid 50 with the railcar dome lid 50 resting on the railcar dome lid device 200. As illustrated in FIGS. 6A-6C, the lid arm 212 props up against and holds the railcar dome lid 50 open. The external holding arm 214 engages with the external portion 26 of the railcar dome wall 22. The internal holding arm 230 engages with and holds on the internal portion 24 of the railcar dome wall 22. The joining arm 250 sets and holds the railcar dome lid device 200 on the top rim 28 of the railcar dome wall 22.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A device for holding a railcar dome lid in an open configuration, the railcar dome lid configured to cover a dome on a railcar, the device comprising:

a base member that includes a lid arm that props up against and holds the railcar dome lid open and an external holding arm opposite the lid arm, the external holding arm engaged with an external wall of the dome on the railcar;

an internal holding arm parallel to the external holding arm, the internal holding arm engaged with an internal wall of the dome on the railcar;

a joining arm that extends perpendicularly from the base member and connects the internal holding arm and the external holding arm, the joining arm seating on a rim of the dome on the railcar; and a support member attached to the lid arm and the joining arm, wherein the support member is a rod.

2. The device of claim 1, wherein the base member and the internal holding arm are 1-½"×1-½" square aluminum tubing.

3. The device of claim 1, wherein the joining arm is 1-½"×1-½" square aluminum tubing.

4. The device of claim 1, wherein the base member is between 20 and 24 inches long.

5. The device of claim 4, wherein the lid arm is between 10 and 12 inches long.

6. The device of claim 5, wherein the internal holding arm and the external holding arm are between 10 and 12 inches long.

7. The device of claim 1, wherein a distance between the internal holding arm and the external holding arm is between 1 to 2 inches.

8. The device of claim 1, wherein the 1-½"×1-½" square tubing of the base member and the internal holding arm is ⅛" thick wall tubing.

9. A device for holding a railcar dome lid in an open configuration, the railcar dome lid configured to cover a dome on a railcar, the device comprising:

a base member that includes a lid arm that props up against and holds the railcar dome lid open and an external holding arm opposite the lid arm, the external holding arm engaged with an external wall of the dome on the railcar, wherein the base member is 2"×2" square tubing;

an internal holding arm parallel to the external holding arm, the internal holding arm engaged with an internal wall of the dome on the railcar, wherein the internal holding arm is 2"×2" square tubing; and a joining arm that extends perpendicularly from the base member and connects the internal holding arm and the external holding arm, the joining arm seating on a rim of the dome on the railcar, wherein a distance between the internal holding arm and the external holding arm is approximately 1 inch.

10. The device of claim 9, wherein the base member and the internal holding arm are 2"×2" square steel tubing.

11. The device of claim 9, wherein the joining arm is 2"×2" square steel tubing.

12. The device of claim 9, wherein the base member is between 30 and 38 inches long.

13. The device of claim 12, wherein the lid arm is between 17 and 21 inches long.

14. The device of claim 13, wherein the internal holding arm and the external holding arm are between 13 and 17 inches long.

15. The device of claim 9, wherein the 2"×2" square tubing of the base member and the internal holding arm is ¼" thick wall tubing.

16. A device for holding a railcar dome lid in an open configuration, the railcar dome lid configured to cover a dome on a railcar, the device comprising:

a base member that includes a lid arm that props up against and holds the railcar dome lid open and an external holding arm opposite the lid arm, the external holding arm engaged with an external wall of the dome on the railcar, wherein the base member is ⅛" thick wall 1-½"×1-½" aluminum square tubing, wherein the base member is approximately 21-22 inches long and the lid arm is approximately 10-11 inches long;

an internal holding arm parallel to the external holding arm, the internal holding arm engaged with an internal wall of the dome on the railcar, wherein the internal holding arm is ⅛" thick wall 1-½"×1-½" aluminum square tubing, wherein the internal holding arm and the external holding arm is approximately 10-11 inches long;

a joining arm that extends perpendicularly from the base member and connects the internal holding arm and the external holding arm, the joining arm seating on a rim of the dome on the railcar, wherein the joining arm is ⅛" thick wall 1-½"×1-½" aluminum square tubing, wherein the joining arm is approximately 3 inches long; and a support member attached to the lid arm and the joining arm, wherein the support member is an aluminum rod in a 90-degree shape.

17. The device of claim 16, wherein the joining arm is connected to the internal holding arm and the base member via welding.

18. The device of claim 16, wherein the joining arm is connected to the internal holding arm and the base member via integral joining techniques.

19. A device for holding a railcar dome lid in an open configuration, the railcar dome lid configured to cover a dome on a railcar, the device comprising:

a base member that includes a lid arm that props up against and holds the railcar dome lid open and an external holding arm opposite the lid arm, the external holding arm engaged with an external wall of the dome on the railcar, wherein the base member is ¼" thick wall 2"×2" steel square tubing, wherein the base member is approximately 33-35 inches long and the lid arm is approximately 18-20 inches long;

an internal holding arm parallel to the external holding arm, the internal holding arm engaged with an internal wall of the dome on the railcar, wherein the internal holding arm is ¼" thick wall 2"×2" steel square tubing, wherein the internal holding arm and the external holding arm is approximately 14-16 inches long; and a joining arm that extends perpendicularly from the base member and connects the internal holding arm and the external holding arm, the joining arm seating on a rim of the dome on the railcar, wherein the joining arm is ¼" thick wall 2"×2" steel square tubing, wherein the joining arm is approximately 1 inch long.

20. The device of claim 19, wherein the joining arm is connected to the internal holding arm and the base member via welding.

* * * * *